US009556506B2

(12) United States Patent
Lee et al.

(10) Patent No.: US 9,556,506 B2
(45) Date of Patent: Jan. 31, 2017

(54) SPALLATION-RESISTANT MULTILAYER THERMAL SPRAY METAL COATINGS

(71) Applicant: KENNAMETAL INC., Latrobe, PA (US)

(72) Inventors: David A. Lee, Ligonier, IN (US); Heidi Lynette de Villiers-Lovelock, Swindon (GB); Danie Jacobus Dewet, Kingston (CA); James B. C. Wu, St. Louis, MO (US)

(73) Assignee: KENNAMETAL INC., Latrobe, PA (US)

( * ) Notice: Subject to any disclaimer, the term of this patent is extended or adjusted under 35 U.S.C. 154(b) by 392 days.

(21) Appl. No.: 14/082,276

(22) Filed: Nov. 18, 2013

(65) Prior Publication Data

US 2014/0072821 A1 Mar. 13, 2014

Related U.S. Application Data

(62) Division of application No. 12/790,183, filed on May 28, 2010, now Pat. No. 8,609,196.

(60) Provisional application No. 61/185,617, filed on Jun. 10, 2009.

(51) Int. Cl.
*C23C 4/06* (2016.01)
*C23C 4/02* (2006.01)

(52) U.S. Cl.
CPC ..... *C23C 4/065* (2013.01); *C23C 4/02* (2013.01); *C23C 4/06* (2013.01); *C23C 4/067* (2016.01); *Y10T 428/12056* (2015.01)

(58) Field of Classification Search
USPC ..... 428/469, 472, 698
See application file for complete search history.

(56) References Cited

U.S. PATENT DOCUMENTS

| | | | |
|---|---|---|---|
| 3,583,290 | A | 6/1971 | Briggs |
| 4,554,130 | A | 11/1985 | Ecer |
| 4,642,440 | A | 2/1987 | Schnackel et al. |
| 5,145,739 | A | 9/1992 | Sarin |
| 5,223,332 | A | 6/1993 | Quets |
| 5,312,653 | A | 5/1994 | Buchanan |
| 6,004,372 | A | 12/1999 | Quets |
| 6,087,022 | A | 7/2000 | Burris et al. |
| 6,641,917 | B2 | 11/2003 | Itsukaichi et al. |
| 6,673,467 | B2 | 1/2004 | Scarlin et al. |
| 7,141,110 | B2 | 11/2006 | Gray et al. |

(Continued)

FOREIGN PATENT DOCUMENTS

| | | | |
|---|---|---|---|
| JP | 62227554 | A | 10/1987 |
| JP | 2003277861 | A | 10/2003 |

OTHER PUBLICATIONS

Kennametal Stellite brochure "hardfacing alloys".*

(Continued)

*Primary Examiner* — Archene Turner
(74) *Attorney, Agent, or Firm* — Larry R. Meenan

(57) ABSTRACT

A multilayer, wear- and corrosion-resistant coating on a metal substrate comprising a first metal coating layer comprising a composite carbide material; a second metal coating layer over the first metal coating layer comprising at least about 50 wt % of a metal selected from the group consisting of Co, Ni, and Fe; and a surface metal coating layer comprising a cemented carbide material having a third-layer carbide material and a third-layer Co-based or Ni-based binder material.

17 Claims, 2 Drawing Sheets

(56) References Cited

U.S. PATENT DOCUMENTS

| | | | |
|---|---|---|---|
| 2005/0112411 | A1 | 5/2005 | Gray et al. |
| 2010/0276209 | A1 | 11/2010 | Yong et al. |

OTHER PUBLICATIONS

Davis, J.R. et al., Tool Materials, Cobalt-Base Alloys, ASM Specialty Notebook, ASM International Handbook Committee, pp. 32-35.
Crook, Paul et al., Corrosion of Nickel and Nickel-Base Alloys, ASM Handbook, vol. 13B, Corrosion: Materials, Copyright 2005 ASM International, pp. 228-251.
Abstract of JP2003277861; Oct. 2, 2003.
Abstract of JP62227554; Oct. 6, 1987.

* cited by examiner

SPALLATION-RESISTANT MULTILAYER THERMAL SPRAY METAL COATINGS

REFERENCE TO RELATED APPLICATION

This is a divisional application based on application Ser. No. 12/790,183 filed May 28, 2010, and claims priority from U.S. provisional application 61/185,617 filed Jun. 10, 2009.

FIELD OF THE INVENTION

The present invention generally relates to a thermal spray coating system having high resistance to spallation under high load and stress, flexure, and severe fatigue conditions. The coating is especially applicable to applications where applied loads are high and high integrity of the coating is required; for example, in connection with aircraft landing gear and a variety of other applications.

BACKGROUND OF THE INVENTION

Hard chrome plating has been traditionally used on in many applications requiring resistance to wear and corrosion. The chrome plating process, however, has been asserted to present health risks to workers due to the presence of hexavalent chromium fumes from the plating bath. Recent OSHA mandate requires exposure to be kept to below 5 mg/cc.

Cemented carbide materials consisting generally of WC, $WC/W_2C$ or variations thereof in a Co-based or Ni-based matrix provide good wear resistance, and provide good corrosion resistance especially when including Cr or the like in the matrix material. However, these materials exhibit cracking and spalling when applied to hardened steel substrates.

SUMMARY OF THE INVENTION

Briefly, therefore, the invention is directed to a method for imparting wear- and corrosion-resistance to a metal substrate and forming a coated substrate, the method comprising applying a first metal coating layer to the substrate by a first thermal spray process depositing a first-layer composite carbide material comprising a first-layer carbide material and first-layer Co-based or Ni-based binder material to provide a bond layer over the metal substrate; applying a second metal coating layer over the first metal coating layer by a second thermal spray process depositing a second-layer coating material comprising at least about 50 wt % of a metal selected from the group consisting of Co, Ni, and Fe to provide a support layer over the bond layer; and applying a surface metal coating layer over the second metal coating layer by a third thermal spray process depositing a third-layer composite carbide material comprising a third-layer carbide material and third-layer Co-based or Ni-based binder material to impart wear- and corrosion-resistance to the outer surface of the coated substrate.

The invention in another aspect is directed to a multilayer, wear- and corrosion-resistant coating on a metal substrate comprising: a first metal coating layer comprising a composite carbide material comprising a first-layer carbide material and a first-layer Co-based or Ni-based binder material; a second metal coating layer over the first metal coating layer comprising at least about 50 wt % of a metal selected from the group consisting of Co, Ni, and Fe; and a surface metal coating layer over the second metal coating layer wherein the surface metal coating layer comprises a cemented carbide material having a third-layer carbide material and a third-layer Co-based or Ni-based binder material.

Other objects and features will be in part apparent and in part pointed out hereinafter.

DESCRIPTION OF THE EMBODIMENT(S) OF THE INVENTION

Figure 1:
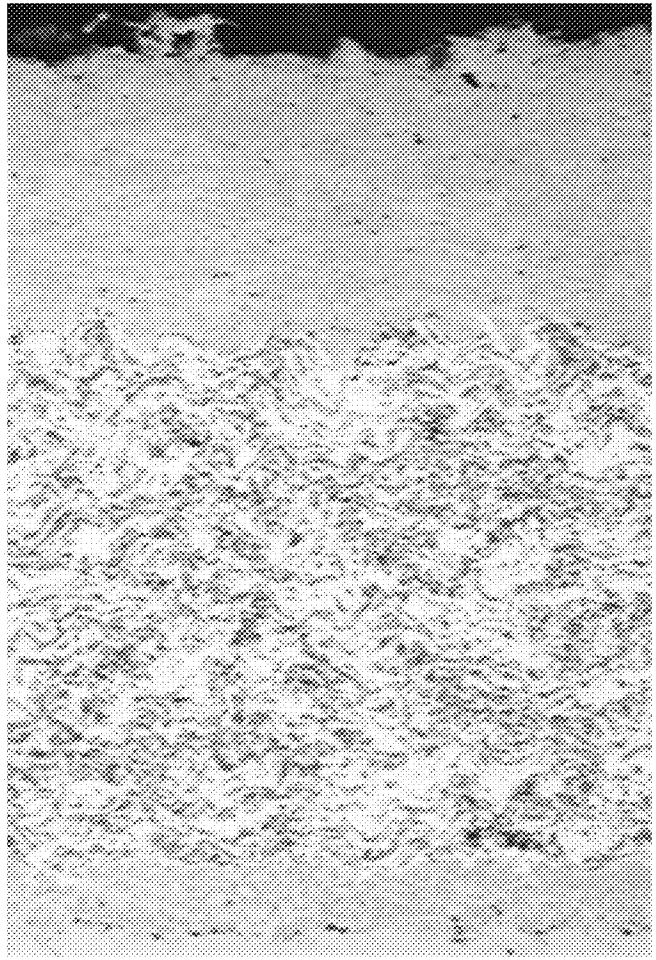
FIG. 1 is a photomicrograph of the coating of the invention taken at 200×.

The present invention is multilayer coating and a method of applying the multilayer coating in which the first coating layer functions as a bond coat to bond subsequent functional layers to the substrate. The second or intermediate layer functions as a support layer. The third layer or surface layer provides external wear and corrosion resistance. The combined layers have a thickness between about 55 and about 600 microns.

The thickness of the first layer is at least about 5 microns and no more than about 50 microns, for example between about 20 and about 40 microns. The thickness is at least 5 microns because a thinner coating runs a risk of being discontinuous in certain locations and does not provide adequate bonding. The thickness is maintained below about 50 microns because a thicker coating is not necessary to obtain the required bonding, and because of a risk of building up residual stresses which may cause cracking under high loads.

The first coating layer, which may also be referred to as the bond layer, is preferably applied to the substrate directly in that there is no layer between the substrate and the first coating layer. Stated another way, the first coating layer is applied directly to the substrate with no intermediate or intervening layers between the substrate and the first coating layer, but the substrate itself may be a completely homogenous metal component or it may be a bulk substrate with coating thereon. In the preferred embodiment, the substrate is a completely homogenous metal component and the first coating layer is applied directly onto the surface and directly interfaces with the bulk metal component surface.

In one embodiment it is an industrial component which is a hardened high strength steel such as compressor rods, hydraulic rods, pump plungers and bearing journals, for example. In preferred embodiment the substrate is an aircraft landing gear. And in one particularly preferred embodiment the substrate is a landing gear typically made of 300M (ASTM A646) or AISI 4340HT high strength steels or other high strength aluminum or titanium alloys.

In view of the hardness of the substrate, the substrate is especially resistant to coating by thermal spray methods. Accordingly, the material of the first coating layer is selected to overcome this resistance. In particular, the material of the first coating layer is selected to have a density which provides sufficient momentum when propelled by thermal spray coating to create a strong bond with the substrate.

The first coating layer material preferably has a density of at least about 10 g/cc. The first coating layer material is a cemented carbide material having a Co-based or Ni-based binder material matrix. In a preferred embodiment the first coating layer material comprises between about 75 and about 88 wt % WC (or $WC/W_2C$) or other first-layer carbide as described herein and between about 12 and about 25 wt % first-layer Co-based or Ni-based (Co or Ni, or Co+Ni) binder material. All percentages herein are by weight unless stated otherwise. This composite carbide material has a density between about 13 g/cc (75WC/25Co—13.1 g/cc) and about 15 g/cc (88WC/12Co—14.3 g/cc). While WC or $WC/W_2C$ is the preferred carbide of the cemented carbide material, other carbides may be used with W partially replaced by other carbide formers such as Ti, Cr, Nb, V, and/or Mo (WCrC, WTaC, WHfC etc.). Stoichiometric WC contains 6.1 wt % C. Eutectic tungsten carbide has 3.9 wt % C and consists of WC and $W_2C$. Alternatively to a Co-based matrix, Ni- or Ni+Co-based matrices may be used as the binder material. The matrix materials (here and in the below described third layer) are referred to as Co-based, Ni-based, and Ni+Co-based in that they may be essentially all Co, Ni, or Ni+Co, or they may contain other alloying elements as are known in the field of cemented carbides.

The first-layer particles at the time of coating are agglomerated and sintered carbide+binder particles where the carbide is the aforementioned WC or WC with W partially replaced and the binder is the Co or Ni or Ni+Co. So substantially each particle prior to contacting the substrate is a carbide-binder composite. The particles during coating deposition become semi-molten or significantly softened state when they reach the substrate during coating. The mix of heat and particle momentum forms a very well bonded and dense structure.

The porosity of the bond coat, as measured using photographic standards or image analysis software as such techniques are well known in the art, is preferably less than about 5%. This high coating density facilitates strong bonding between the substrate and the subsequent layers because micro-interlocking with the substrate surface.

The second coating layer, which may also be referred to as the support layer, is an intermediate layer positioned between the first or bond coating layer and the third or surface coating layer. This intermediate layer is deposited over the first metal layer either directly onto and interfacing with the first metal layer, or indirectly in that there may be intervening layers between the first and second layers. However, in the preferred embodiment the second layer is deposited directly onto the first metal layer with no intervening layers. The second layer functions as a support coat to support the top layer under stress. The support coat carries the majority of the load exerted on the coating. The material for this layer has toughness and good crack resistance, so this it preferably a Co, Ni, or Fe-based alloy. Corrosion resistance is also required for applications in corrosive environments.

A suitable Co-based material for the second layer has at least about 60 wt % Co and the balance alloying elements. For example, the Stellite brand family of alloys has alloys which are suitable. This material has between about 0.1 and about 1.4 wt % C, between 0 and about 10 wt % Mo, between 0 and about 10 wt % W, between about 20 and 35 wt % Cr, and balance Co and incidental impurities. An example of a suitable material for this second layer or support layer is a Co-based alloy containing 28 wt % Cr, 5.5 wt % Mo and 0.25 wt % C, balance Co and incidental impurities.

A suitable Ni-based material for the second layer has at least about 60 wt % Ni and the balance alloying elements. For example, this material has between 0.0003 and 0.8 wt % C, between 0 and 20 wt % Mo, between 10 and 50 wt % Cr, balance Ni and incidental impurities. An example of a suitable material for this second layer or support layer is a Ni-based alloy containing 0.1 wt % C, 16 wt % Cr, 16 wt % Mo, balance Ni and incidental impurities.

A suitable Fe-based material for the second layer has at least about 70 wt % Fe and the balance alloying elements. For example, this material has between about 15 and about 26 wt % Cr, between about 8 and about 22 wt % Ni, between 0 and about 5 wt % Mo and between about 0.03 and about 0.5 wt % C, balance Fe and incidental impurities. An example of a suitable material for this second layer or support layer is a Fe-based alloy containing 17 wt % Cr, 12 wt % Ni, 2.5 wt % Mo, 0.03 wt % C, balance Fe.

The second layer has a thickness of at least about 25 microns. In most embodiments the thickness of the second layer is less than about 400 microns, such as less than about 350 microns. In one preferred embodiment the thickness of the second layer is between about 50 and about 200 microns.

The hardness of the second layer is preferably between about 400 and about 600 on the Vickers (DPH) scale to 300 g load. If the hardness of the second coating layer is significantly above 600, then the coating becomes too brittle to carry load without cracking. If it is significantly below 400, then it is not strong enough to stand the stress transmitted from the top coating.

The density of the second layer is at least about 5 g/cc, preferably between about 4 g/cc and about 8 g/cc.

The multilayer coating of the invention further comprises a third coating layer or surface coating layer which is on the outer surface of the coated component and provides wear and corrosion resistance. This layer is exposed to harsh service environments encountered in landing gear and other industrial applications and therefore provides desired wear and/or corrosion resistance. In the case of landing gear, the surface layer withstands wear from the deployment and retraction of the gear, and corrosion from seawater and salt-bearing mist, hydraulic fluids and lubricants. In the currently preferred embodiment this surface coating layer is applied directly to and interfaces with the second layer or support layer, with no layers intervening between the surface layer and the support layer. In the embodiment which is landing gear, for example, the surface coating layer provides protection against corrosion from water and salt water and salt mist, and it provides resistance to wear accompanying repeated deployment and retraction.

The surface coating layer is at least about 25 microns thick in order to provide the desired functionality. In most embodiments it is less than about 250 microns thick. In one preferred embodiment the thickness of the second layer is between about 40 and about 100 microns.

The surface coating layer is in direct contact with the wear and corrosive environments and is therefore formed from a carbide+metal composite material in a Co-based or Ni-based or Co+Ni-based matrix which contains WC, $WC/W_2C$ or $Cr_3C_2$ (or analogous carbides as described above) to provide wear resistance and Cr in the matrix to provide corrosion resistance. For example, in one embodiment the surface coating layer material has between about 65 and about 92 wt % carbide, such as between about 75 and about 92 wt % carbide, and between about 8 wt % and about 35 wt % Co-based or Ni-based binder material, such as between about 8 wt % and about 25 wt % Co-based or Ni-based binder material. One such material has between about 75 and about 92 wt % carbide, and between about 3 and about 8 wt % Cr, and between about 5 and about 22 wt % Co constituting the binder material.

The final coating therefore comprises a first-layer bond coating of composite carbide material; a second-layer support coating of Co-based, Ni-based, or Fe-based alloy; and a third-layer surface coating of composite carbide material. In a preferred embodiment the first and third layers finished layers are composite carbide materials. The composite carbide powder particles prior to thermal spraying are prepared by agglomeration typically with a temporary organic binder via mixer or by spray drying. The material or particles are then sintered to liberate the organic binder and to densify the material or particles. The material can be crushed to form particles, or in the case of particles made by spray drying they can be further densified by further densification using heat treatment such as sintering or hot isostatic pressure (HIP), combustion, or plasma flame. The powder is not typically fully densified as this would significantly increase the risk of carbide phase changes and decomposition and alloying with the matrix. Also the particle density is important during the spray process in producing the coating since the particle velocity is significantly high to limit time for melting and compaction of the particles during the coating process to form a dense well bonded coating. So in one preferred embodiment the tungsten carbide powder particles prior to thermal spraying are less than fully dense, that is, they have a density of less than about 70% of theoretical density. In an alternative embodiment, in contrast, the tungsten carbide particles prior to thermal spraying are more fully dense, that is, they have a density of greater than about 73% of theoretical.

In a preferred embodiment the thickness of the third or surface coating layer is selected so that the second or intermediate support coating layer is from about one-third to about ten times the thickness of the surface layer. This helps provide second-layer thickness sufficient to provide support for the top layer, while not so thick as to promote cracking. Thickness mismatch outside this range risks cracking due to differential thermal expansion and stress distribution under load. So in certain preferred embodiments, the thickness of the third layer is between about 25 and about 250 microns, preferably between about 75 and about 100 microns, and in certain preferred embodiments between about 100 and about 200 microns. These thickness criteria of the third layer are independent criteria for the third layer, which are within the aforementioned second layer:third layer desired thickness ratio of between about 1/3:1 and about 10:1.

Each of the first, second, and third layers is applied by a thermal spray technique because thermal spraying provides ease and flexibility in the application and is suitable for application of all of the materials contemplated for the respective layers. Suitable thermal spray techniques include high velocity oxyfuel (HVOF), detonation gun, plasma spraying, and high velocity air fuel (HVAF).

The following non-limiting examples further illustrate the invention.

EXAMPLE 1

A multilayer coating of WC—Co bond coating layer, a Co—Cr—Mo—C support coating layer, and a WC—Co based surface coating layer were applied to an Almen Type N steel strip of 0.75 mm thick prepared according to SAE J442 having hardness of HRC 45-50. Each of the coating layers was applied by Jet Kote, a commercially available high velocity oxyfuel thermal spray process. The fuel used was hydrogen and the parameters as shown here in Table A:

TABLE A

| Alloy | $H_2$ SCFH | $O_2$ SCFH | Ar SCFH | Powder, g/min | Nozzle, Bore × length | SD, inches | Part speed, ft/min | Torch speed, in/sec |
|---|---|---|---|---|---|---|---|---|
| JK117 | 1150 | 570 | 57 | 35.5 | 1/4 × 9 | 8 | 294 | 0.8 |
| Stellite 21 | 1200 | 550 | 63 | 40.0 | 1/4 × 9 | 8 | 294 | 0.8 |
| JK120H | 1380 | 600 | 57 | 37.0 | 1/4 × 6 | 8 | 359 | 1.0 |

The bond coating layer was 25 microns thick of a composite carbide material (JK® 117) of 83 wt % WC in a matrix of 17 wt % Co. The support coating layer was 225 microns thick and formed from a fully pre-alloyed powder (JK 571, corresponding generally to Stellite 21) of approximately 28 wt % Cr, 5 wt % Mo, 2.5 wt % Ni, 0.25 wt % C, and balance Co. The surface coating layer was 100 microns thick of a composite carbide material (JK 120H) of 86 wt % WC in a matrix of 10 wt % Co and 4 wt % Cr. The thickness ratio of the support coat to the surface coat was 2.25:1. The coating on the substrate was mounted and prepared by standard metallographic techniques and a photomicrograph thereof is presented in FIG. 1. Viewing from left to right in the photomicrograph, the surface coat is on the left, over the support coat in the middle, over the bond coat on the right. It is observed that the 17 wt % Co in the bond coat layer provided sufficient soft Co matrix to provide a strong bond to both the hardened steel substrate and to the support coat. It is thought that the Co in the coating layers has greater bonding strength than mechanical bonding alone (mechanical bonding is typical for thermal spray coatings); i.e., that a bond such as a diffusion bond or strong atomic bond forces (attraction) occurs here which is responsible for the increase in bonding between the layers.

EXAMPLE 2

A monolayer of alloy JK® 120H having a thickness of 375 microns was applied to a hardened high strength steel coupon (an Almen Type N steel strip of 0.75 mm thick prepared according to SAE J442 having hardness of HRC 45-50). JK® 120H is a cemented carbide material comprising 86 wt % WC in a matrix of 10 wt % Co and 4 wt % Cr.

Figure 2A:
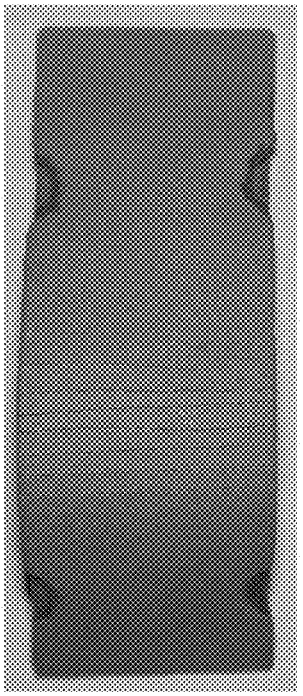
FIG. 2A is a photomicrograph of a test coupon demonstrating an aspect of the invention.
Figure 2B:
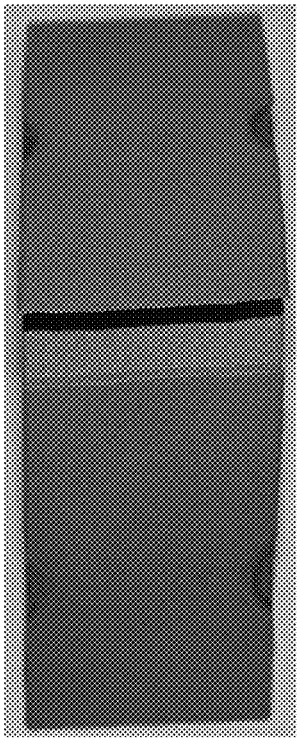
FIG. 2B is a photomicrograph of a comparative test coupon not of the invention.

This coupon and the coupon of Example 1, each having dimensions of 0.76 mm by 19 mm by 76 mm, were subjected to a 180-degree bending test. The coupon of Example 1 is shown in FIG. 2A and the coupon of Example 2 is shown in FIG. 2B. FIG. 2A shows only barely visible fine cracks in the apex region, while FIG. 2B shows a brittle fracture and spalling at the apex.

EXAMPLE 3

A fatigue test according to ASTM E-466-96 was performed. Small straight gage fatigue bars of AISI 4340HT with a diameter of 0.25 inch were coated in the 0.75-inch gage length and ground to a finish of Ra 32. The stress level applied was 220 ksi at R=−1, which means the compressive load is equal to tensile load. The frequency was 20 Hz. The maximum stress was set at the yield point of the base metal to simulate severe conditions. The results are presented in Table 1. Specimens 107, 108, 109, and 110 correspond to the three-layer coatings of the invention prepared under the process as described in Example 1, but with the layer thicknesses described below. Specimens 103, 104, 105, and 106 correspond to two-layer coatings not of the invention with the layers applied by the Jet Kote thermal spray process. The fuel in all the foregoing spray operations was hydrogen.

TABLE 1

SMALL BAR ASTM E466 FATIGUE TEST

| Specimen | 25-micron thick 1st Layer | 2nd Layer | Thickness in Microns | 3rd Layer | Thickness in Microns | Cycles to Spalling |
|---|---|---|---|---|---|---|
| 103 | JK 117 | JK 571 | 50 | None | N/A | 664 |
| 104 | JK 117 | JK 571 | 50 | None | N/A | 669 |
| 105 | JK 117 | JK 571 | 275 | None | N/A | 25 |
| 106 | JK 117 | JK 571 | 275 | None | N/A | 64 |
| 107 | JK 117 | JK 571 | 200 | JK 120H | 50 | 43 |
| 108 | JK 117 | JK 571 | 200 | JK 120H | 50 | 751* |
| 109 | JK 117 | JK 571 | 25 | JK 120H | 75 | 566 |
| 110 | JK 117 | JK 571 | 25 | JK 120H | 75 | 617 |

*Specimen 108 demonstrated good cycles-to-spalling, but cracking was observed at just 11 cycles and longitudinal cracking was observed after just 90 cycles.

The thin coating of Co—Cr—Mo—C (JK 571) at 50 microns over 25 microns WC—Co (JK 117) shows strong resistance to fatigue as demonstrated by Specimens 103 and 104. In specimens 105 and 106 with Co—Cr—Mo—C (JK 571) coating thickness at 275 microns, the fatigue resistance dropped significantly. With the three-layer system, the coatings with Co—Cr—Mo—C support coat (JK 571) at 25 microns (Specimens 109 and 110) and WC—CoCr (JK 120H) surface coat performed much better than those with the same support coat at 200 microns (Specimens 107 and 108).

A further series of tests were performed but are not presented in Table 1 because the tests were abandoned. In particular, a thin monolayer WC—CoCr (JK 120H) coating with no bond or support coat performed well in a bend test, but it was found that the stress load could not be raised beyond 190 ksi in the small bar test without spalling soon after the start of the fatigue test. Testing of these specimens was therefore abandoned.

EXAMPLE 4

Testing was performed to simulate loads of jet fighters landing in poor condition on aircraft carriers where the stress loads could exceed the plastic deformation of the high strength steels. The test was referred as "big bar" as it was designed to have similar characteristic of a main landing gear strut of a Boeing F-18. Additional description of this test can be found on page 167 of HCAT Final report "Validation of HVOF WC/Co Thermal Spray Coating as alternative to Hard Chrome Plating Aircraft on Landing Gear" document NRL/MR/6170-04-8762 dated Mar. 31, 2004. Table 2 list the results of this test with 20 cycles without coating spallation consider a successful coating. The big bar test was performed with pipe specimens of 2.25-2.35 inches in outer diameter and 2.0-2.1 inches in inside diameter. Only the gage length of 4.1 inches was coated. All coatings were ground to a smooth finish of Ra 8-12 microinches. The total coating thickness was kept at 375 microns. The maximum stress was set at 240 ksi and the fatigue frequency 1 Hz with a sinusoidal wave. The test results are presented in Table 2.

TABLE 2

BIG BAR FATIGUE TESTS

| Specimen Number | Coating System* | Coating Thickness in Microns | Max Stress (Ksi) | Cycles to Spalling |
|---|---|---|---|---|
| A-1 | JK 120 | 375 | 228** | 1 |
| A-2 | JK 120 | 375 | 200 | 63 |

TABLE 2-continued

BIG BAR FATIGUE TESTS

| Specimen Number | Coating System* | Coating Thickness in Microns | Max Stress (Ksi) | Cycles to Spalling |
|---|---|---|---|---|
| A-3 | JK 120 | 375 | 220 | 16 |
| A-4 | JK 120 | 375 | 200 | 8 |
| B-1 | JK 571 over JK 117 | 350/25 | 240 | 40 |
| B-2 | JK 571 over JK 117 | 350/25 | 240 | 62 |
| B-3 | JK 571 over JK 117 | 350/25 | 240 | 54 |
| C-1 | JK 120H over JK 571 over JK 117 | 60/250/25 | 240 | 30 |
| C-2 | JK 120H over JK 571 over JK 117 | 60/250/25 | 240 | 33 |
| C-3 | JK 120H over JK 571 over JK 117 | 60/250/25 | 240 | 79 |

*Both A and B series were sprayed with methane fuel. The C series was sprayed with hydrogen fuel.
**The A-1 coating spalled before the maximum stress of 240 ksi was reached and lower maximum stress were used with other A series specimens.

The results indicate that spalling occurred with single layer coatings of WC—CoCr (JK 120) before the stress load could reach the intended level of 240 ksi. The two- and three-layer systems had much better results. Most importantly, the three-layer coating system with the desired WC—CoCr (JK 120H) surface layer exceeded the targeted performance of 20 cycles in all three specimens. The B-series tests of Co—Cr—Mo—C also passed the fatigue tests, but were known to have insufficient wear resistance because they lacked a WC—CoCr or other wear-resistant surface coating.

In conclusion, the test results show that the three-layer coating system of the invention is suitable to create a wear resistant tungsten-carbide-containing surface layer that is resistant to spallation under severe fatigue conditions, especially when coating hardened high strength steels.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description and shown in the accompanying drawing shall be interpreted as illustrative and not in a limiting sense.

What is claimed is:

1. A multilayer, wear- and corrosion-resistant coating on a metal substrate comprising:

a first metal coating layer having a thickness between about 5 and about 50 microns and comprising a composite carbide material comprising a first-layer composite carbide material and a first-layer Co-based or Ni-based binder material;

a second metal coating layer over the first metal coating layer comprising at least about 50 wt % of a metal selected from the group consisting of Co, Ni, and Fe; and a surface metal coating layer over the second metal coating layer wherein the surface metal coating layer comprises a cemented carbide material having a third-layer composite carbide material and a third-layer Co-based or Ni-based binder material.

2. The multilayer wear- and corrosion-resistant coating of claim 1 wherein:

the first metal coating layer has a thickness of no more than about 50 microns and the first-layer composite carbide material comprises between about 75 and about 88 wt % first-layer carbide material and between about 12 and about 25 wt % first-layer Co-based or Ni-based binder material.

3. The multilayer wear- and corrosion-resistant coating of claim 1 wherein:

the second-layer coating material is a Co-based material having at least about 60 wt % Co.

4. The multilayer wear- and corrosion-resistant coating of claim 1 wherein:

the first, second, and third layers have a combined thickness of between about 55 and about 600 microns.

5. The multilayer wear- and corrosion-resistant coating of claim 1 wherein:

the first-layer composite carbide material comprises about 83 wt % carbide material WC or $WC/W_2C$ and about 17 wt % Co.

6. The multilayer wear- and corrosion-resistant coating of claim 1 wherein:

the second layer coating material comprises between about 0.1 and about 1.4 wt % C, between 0 and about 10 wt % Mo, between 0 and about 10 wt % W, between about 20 and 35 wt % Cr, and balance Co and incidental impurities.

7. The multilayer wear- and corrosion-resistant coating of claim 1 wherein:

the second layer has a thickness between about 50 and about 200 microns.

8. The multilayer wear- and corrosion-resistant coating of claim 1 wherein:

the third-layer composite carbide material comprises between about 65 and about 92 wt % third-layer carbide material $Cr_3C_2$, WC or $WC/W_2C$ and between about 8 wt % and about 35 wt third-layer Co-based or Ni-based binder material.

9. The multilayer wear- and corrosion-resistant coating of claim 1 wherein:

the third-layer composite carbide material comprises between about 75 and about 92 wt % third-layer carbide material, and between about 3 and about 8 wt % Cr and between about 5 and about 22 wt % Co constituting the third-layer binder material.

10. The multilayer wear- and corrosion-resistant coating of claim 1 wherein:

the third-layer composite carbide material comprises about 86 wt % carbide material WC or $WC/W_2C$, about 10 wt % Co, and about 4 wt % Cr.

11. The multilayer wear- and corrosion-resistant coating of claim 1 wherein:

the third coating layer has a thickness between about 25 microns and about 250 microns.

12. The multilayer wear- and corrosion-resistant coating of claim 1 wherein:

the third coating layer has a thickness between about 40 microns and about 100 microns.

13. The multilayer wear- and corrosion-resistant coating of claim 1 wherein:

the first-layer composite carbide material comprises between about 75 and about 88 wt % first-layer carbide material and between about 12 and about 25 wt % first-layer Co-based binder material;

the second layer coating material comprises between about 0.1 and about 1.4 wt % C, between 0 and about 10 wt % Mo, between 0 and about 10 wt % W, between about 20 and 35 wt % Cr, and balance Co and incidental impurities; and the third-layer composite carbide material comprises between about 75 and about 92 wt % third-layer carbide material, and between about 3 and about 8 wt % Cr and between about 5 and about 22 wt % Co constituting the third-layer binder material.

14. The multilayer wear- and corrosion-resistant coating of claim 13 wherein:

the second layer has a thickness between about 50 and about 200 microns;

the third coating layer has a thickness between about 40 microns and about 100 microns; and the first, second, and third layers have a combined thickness of between about 55 and about 600 microns.

15. The multilayer, wear- and corrosion-resistant coating on a metal substrate of claim 1 wherein:

the first-layer composite carbide material comprises between about 75 and about 88 wt % first-layer carbide material and between about 12 and about 25 wt first-layer Co-based or Ni-based binder material; and the second metal coating layer over the first metal coating layer comprises at least about 60 wt % Co.

16. The multilayer wear- and corrosion-resistant coating of claim 1 wherein:

the second layer coating material consists of between about 0.1 and about 1.4 wt % C, between 0 and about 10 wt % Mo, between 0 and about 10 wt % W, between about 20 and 35 wt % Cr, and balance Co and incidental impurities.

17. The multilayer wear- and corrosion-resistant coating of claim 1 wherein:

the first-layer composite carbide material consists essentially of between about 75 and about 88 wt % first-layer carbide material and between about 12 and about 25 wt % first-layer Co-based binder material;

the second layer coating material consists essentially of between about 0.1 and about 1.4 wt % C, between 0 and about 10 wt % Mo, between 0 and about 10 wt % W, between about 20 and 35 wt % Cr, and balance Co and incidental impurities;

the third-layer composite carbide material consists essentially of between about 75 and about 92 wt % third-layer carbide material, and between about 3 and about 8 wt % Cr and between about 5 and about 22 wt % Co constituting the third-layer binder material;

the first layer has a thickness between about 5 and about 50 microns;

the second layer has a thickness between about 50 and about 200 microns; and the third coating layer has a thickness between about 40 microns and about 100 microns.

* * * * *